US005432403A

United States Patent [19]

Shaffer

[11] Patent Number: 5,432,403

[45] Date of Patent: Jul. 11, 1995

[54] NEGATIVE GLOW DISCHARGE LAMP HAVING IMPROVED COLOR STABILITY AND ENHANCED LIFE

[75] Inventor: John W. Shaffer, Danvers, Mass.

[73] Assignee: GTE Products Corporation, Danvers, Mass.

[21] Appl. No.: 712,818

[22] Filed: Jun. 10, 1991

[51] Int. Cl.[6] ..... H01J 61/067

[52] U.S. Cl. ..... 313/619

[58] Field of Search ..... 313/619, 639, 642, 576

[56] References Cited

U.S. PATENT DOCUMENTS 2,409,769 10/1946 Leyshon ..... 176/122
2,421,571 6/1947 Leyshon ..... 176/122
4,904,900 2/1990 Bouchard et al. ..... 313/491
5,027,030 6/1991 Bouchard et al. ..... 313/619

FOREIGN PATENT DOCUMENTS 106942 11/1939 Australia ..... 313/642

*Primary Examiner*—Sandra L. O'Shea
*Attorney, Agent, or Firm*—Carlo S. Bessone

[57] ABSTRACT

A negative glow discharge lamp having improved color stability and increased life includes a light-transmitting envelope which contains an ionizable medium including mercury and a gaseous fill. The gaseous fill includes neon and a predetermined amount of krypton. The krypton is in an amount equal to less than five percent of the gaseous fill.

9 Claims, 1 Drawing Sheet

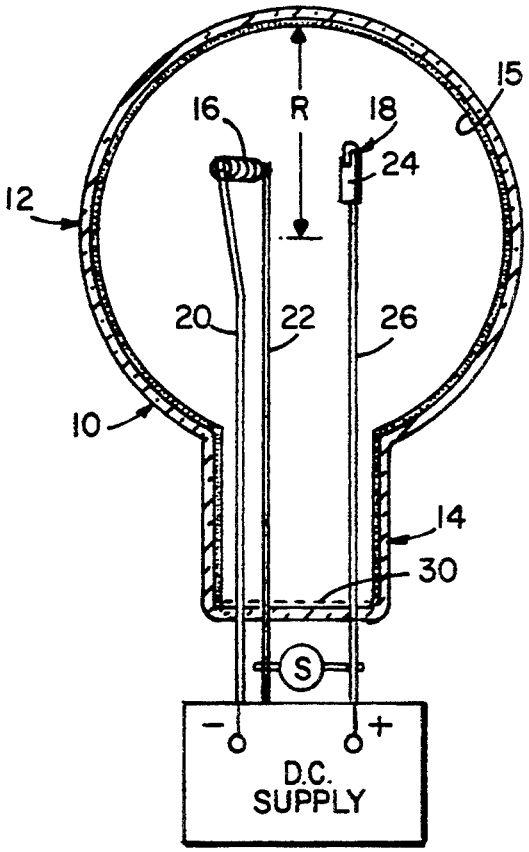
15
16
R
18
24
12
20
22
26
10
14
30
S
−
+
D.C.
SUPPLY

NEGATIVE GLOW DISCHARGE LAMP HAVING IMPROVED COLOR STABILITY AND ENHANCED LIFE

FIELD OF THE INVENTION

This invention relates in general to electric lamps and pertains, more particularly, to negative glow discharge lamps.

BACKGROUND OF THE INVENTION

A negative glow discharge lamp typically is comprised of an hermetically sealed light-transmitting envelope in which are located a cathode and an anode supported by associated lead-in wires. A phosphor coating is provided on the inner surface of the lamp envelope. A quantity of fill gas and mercury are introduced into the lamp during manufacturing. An example of a such a negative glow discharge lamp is described in U.S. Pat. No. 4,904,900, which issued to Bouchard et al and is assigned to the same Assignee as the present application.

Operation of a typical glow discharge lamp is as follows. Electrical heating of the cathode causes thermionic emission of electrons. These electrons are accelerated to about 15 electron volts of energy by the presence of a sheath of positive mercury ions about the cathode. These electrons impinge on gas and especially mercury atoms causing ionization with the release of secondary electrons. Both the primary and secondary electrons can excite mercury atoms such that they give up their acquired energy in the form of ultraviolet photons. It is these UV photons that strike the phosphor and cause it to emit visible light. Electrons enter the anode to complete the electrical circuit through the lamp.

Negative glow discharge fluorescent lamps differ principally from conventional positive column fluorescent lamps in that the electrons in the plasma thereof comprise entirely energetic primary electrons accelerated by the cathode fall and secondary electrons released by collision of those primary electrons with atoms in the gaseous phase of the lamp. There is no low voltage gradient positive column in which the electrons acquire a "drift" velocity.

In order to achieve reasonable discharge efficiencies in a negative glow discharge lamp (e.g., 30 lumens per watt or higher), it is necessary to use a fill gas that is not readily ionized or excited by the energetic primary electrons, which have energies on the order of 15 electrons volts. Argon, and the heavier inert gases, are excited by such electron energies and typically result in lumen losses of 40 percent or more compared to neon. Helium, which is the most resistant inert gas toward ionization or excitation, also has been found to promote serious lamp efficiency losses relative to neon by virtue of its low atomic mass and resulting high elastic scattering losses. Much test data has therefore shown that the use of neon as the fill gas is optimum for negative glow fluorescent lamps.

An undesirable consequence of the use of neon as the fill gas in such lamps is that any conditions that tend to elevate lamp operating voltage, as for example low ambient temperature, result in red neon excitation and a disturbing nonuniformity of color from lamp to lamp. Such color shift is often seen during lamp starting, and also occurs under certain dimming conditions. The ability to dim negative glow fluorescent lamps over essentially their full operating range is one of the attractive features of such lamps. A ballast supply that provides elevated voltage spikes in its waveform can promote ongoing neon excitation during lamp life. Additionally, the ability of the lamp to realize such elevations in voltage results in significant sputtering of the cathode coating and a reduction in lamp life relative to what the life could be if the discharge voltage were somehow more of less truncated at, for example, 14.5 volts.

Various quantities of krypton have been used in the fill of fluorescent glow lamps not containing mercury. For example, U.S. Pat. No. 2,409,769 teaches the use of preferably neon when cadmium borate is used in the coating to give red or pink light. According to the patent, the characteristic red light produced by the neon will supplement that produced by excitation of the coating. A small amount of krypton (i.e., less than one percent) is added to the neon.

U.S. Pat. No. 2,421,571 relates to another fluorescent glow lamp without mercury. The gaseous atmosphere taught by the patent consists of true inert gases which do not condense at ambient or operating temperatures. According to the patent, when atmospheres of certain materials such as mercury vapor are used, the life and efficiency of the lamp is greatly impaired by condensation which blocks out a substantial portion of the visible light emitted from the lamp. In one example of pink and yellow lamps, a gaseous mixture of 95 to 99 percent neon and the rest krypton is taught.

Although the use of krypton in standard positive column fluorescent lamps is well known, its use in negative glow type discharge lamps of high desired lumen output (e.g., over 100 lumens) has been considered detrimental to those skilled in the art of negative glow discharge lamp making.

SUMMARY OF THE INVENTION

It is, therefore, an object of the present invention to obviate the disadvantages of the prior art.

It is still another object of the invention to provide a negative glow discharge lamp having improved color stability.

It is another object of the invention to provide a negative glow discharge lamp having enhanced life.

These objects are accomplished in one aspect of the invention by the provision of a negative glow discharge lamp comprising a light-transmitting envelope containing an ionizable medium at a low pressure including mercury and a gaseous fill comprising substantially neon and a predetermined amount of krypton. The amount of krypton is less than five percent of the total gaseous fill and is effective to improve color stability and increase lamp life. A pair of electrodes is disposed in the envelope and is exposed to the gas fill material. Lead-in wires are coupled to the electrodes and extend through and are hermetically sealed in the envelope.

In accordance with further teachings of the present invention, the amount of krypton is less than two percent of the gaseous fill and, preferably, equal to one-half percent.

The above objects are accomplished in another aspect of the invention by the provision of a negative glow discharge lamp comprising a light-transmitting envelope containing an ionizable medium at a low pressure including mercury and a gaseous fill consisting essentially of neon and krypton. The krypton is in an amount equal to less than five percent of the gaseous fill.

Additional objects, advantages and novel features of the invention will be set forth in the description which follows, and in part will become apparent to those skilled in the art upon examination of the following or may be learned by practice of the invention. The aforementioned objects and advantages of the invention may be realized and attained by means of the instrumentalities and combination particularly pointed out in the appended claims.

BRIEF DESCRIPTION OF THE DRAWING

The invention will become more readily apparent from the following exemplary description in connection with the accompanying drawing, wherein:

The sole FIGURE represents a front elevation cross-sectional view of a preferred embodiment of a negative glow discharge lamp according to the present invention.

BEST MODE FOR CARRYING OUT THE INVENTION

For a better understanding of the present invention, together with other and further objects, advantages and capabilities thereof, reference is made to the following disclosure and appended claims in connection with the above-described drawing.

Referring to the drawing, the sole FIGURE illustrates a negative glow discharge lamp including a light-transmitting, hermetically-sealed envelope 10 that has a bulbous or spherical-shaped region 12 and a neck region 14. Region 12 of envelope 10 has an internal radius R, such as 1.375 inches. Within spherical-shaped region 12 of envelope 10 there is disposed a pair of electrodes such as a cathode electrode 16 and an anode electrode 18. The electrodes are typically spaced approximately 1 to 3 centimeters apart.

The cathode electrode 16 may be a tungsten exciter coil having a co-precipitated triple carbonate suspension, usually comprising strontium carbonate, calcium carbonate, and barium carbonate deposited thereon. The cathode electrode can vary in size, mass and geometry depending on starting features required, expected life and current carrying capabilities. During lamp manufacturing, the carbonates are converted to oxides during the well known breakdown or activation process in which current is passed through the cathode for a predetermined amount of time. Lead-in wires 20 and 22 support cathode electrode 16 and provide electrical power thereto. Anode electrode 18 comprises a refractory metal strip 24 supported by a single lead-in wire 26.

Lead-in wires 20, 22, 26 are hermetically sealed such as by means of a wafer stem assembly 30 that closes the bottom neck region 14 of the lamp envelope as illustrated in the sole FIGURE. The lead-in wires may be rod-like of say 20 to 30 mil diameter.

As further shown in the sole FIGURE, lead-in wires 20 and 26 are respectively connected to the negative and positive terminals of a DC power supply. To start the lamp, preheat current is supplied to cathode electrode 16 by momentarily connecting together lead-in wires 22 and 26. As shown, a conventional glow discharge starter S may be secured to lead-in wires 22 and 26 to facilitate the preheating and starting. Upon ignition, a glow discharge is produced between cathode electrode 16 and anode electrode 18.

Envelope 12 is provided with a phosphor coating 15 and contains an ionizable medium that emits ultraviolet radiation upon excitation. The ionizable medium contains mercury and a gaseous fill comprising primarily neon. Although the use of heavier inert gases, such as argon, krypton, and xenon as the primary fill gas results in unacceptable lumen loss in negative glow fluorescent discharge lamps, it has been found that the addition of a small quantity of preferably krypton to the neon fill gas offers significant advantages. Although the addition of krypton was found to result in a decrease of about seven percent in lamp lumens per one percent of krypton in the fill gas, it has been discovered that this loss in light output is more than compensated for by improved color stability, increased lumen maintenance, and increased lamp life. Although the beneficial effects are also present at levels of five percent and higher, lumen loss is considered unacceptable for most general lighting purposes.

In accordance with the teaching of the present invention, the ionizable medium of the negative glow discharge lamp in addition to mercury contains a gaseous fill comprising primarily neon and the balance krypton. The amount of krypton is typically less than five percent of the total fill and preferably less than two percent of the total fill.

While krypton is preferred, it is believed that xenon could similarly be used. The xenon would have a similar effect as the krypton while requiring lower percentages in the fill than krypton. However, the relative cost of xenon, and the lack of known advantages relative to krypton, tend to preclude its use.

It is expected that the benefits of krypton, as a minor additive to the fill gas, could be realized together with the benefits taught for nitrogen and described in U.S. Pat. No. 4,929,868 which issued to Bouchard and is assigned to the same Assignee as the present application.

As typical but non-limitative examples of negative glow discharge lamps made in accordance with the teachings of the present invention, a series of lamps were constructed similar to that illustrated in the sole FIGURE. Each lamp was fabricated from incandescent-type bulbs of 2.75 inch diameter (R=1.375 inch) internally coated with phosphor blended to give a correlated color temperature of 2800 Kelvin. The lamp cathodes were coated with approximately 25 milligrams of a conventional emissive coating formulated from barium, strontium, and calcium carbonates and zirconium dioxide. Each lamp contained an anode electrode fabricated from 0.001 inch thick molybdenum foil and had an area of 3/16 inch by $\frac{5}{8}$ inch, and were spaced 0.5 inch from the cathode. Lamp fill gas was at 1.5 torr pressure. Mercury dosage was 16 milligrams.

Photometry of the above lamps was done following a 16 hour overnight seasoning burn-in of the lamps. The test lamps contained either one percent or five percent krypton with the balance being neon. The test lamps were compared to control lamps containing 99.5 percent neon and 0.5 percent argon. TABLE I below illustrates the light output and efficiency for each group operating on a 2.0 ampere DC circuit.

TABLE I

| FILL GAS | NO. OF LAMPS | VOLTS | WATTS | LUMENS | LPW |
|---|---|---|---|---|---|
| 99% Ne/ 1% Kr | 4 | 14.5 | 29.1 | 855 | 29.4 |

TABLE I-continued

| FILL GAS | NO. OF LAMPS | VOLTS | WATTS | LUMENS | LPW |
|---|---|---|---|---|---|
| 95% Ne/ 5% Kr | 3 | 12.2 | 24.7 | 597 | 24.2 |

The data contained in TABLE I show the effect on electrical parameters caused by increasing the percent of krypton in the fill. More specifically, as the percent of krypton is increased from one to five percent, discharge voltage, lamp wattage, lamp lumens and lumens per watt (LPW) tend to decrease.

A similar group of test lamps were prepared with the exception that this group of lamps had a 5 millimeter strip of ST-198 getter (available from SAES Getters/ U.S.A., Inc., 1122 E. Cheyenne Mtn. Blvd., Colorado Springs, Colo. 80906) weld attached to an electrically floating lead wire 0.5 inch below the cathode. Half of these lamps were filled with neon containing 0.5 percent argon to serve as control (C), and the other half were filled with neon containing 0.5 percent krypton as test lamps (T). In the data contained in TABLE II below, percent lumen maintenance is referenced to the 136 hour lumen output. The LPW calculation includes cathode power. In this regard, cathode power equals two watts at each recorded interval except the 2230 hour group where the cathode power equaled four watts.

TABLE II

| HRS. | NO. OF LAMPS | VOLTS | WATTS | LUMENS | LPW | % LUMEN MAINT. | % CATHODE COATING |
|---|---|---|---|---|---|---|---|
| 136 | C: 3 | 14.1 | 28.2 | 858 | 28.4 | 100 | 100 |
| | T: 3 | 13.3 | 26.7 | 804 | 28.0 | 100 | 100 |
| 592 | C: 3 | 14.6 | 29.2 | 753 | 24.1 | 88 | — |
| | T: 3 | 13.7 | 27.4 | 752 | 25.6 | 94 | — |
| 1028 | C: 3 | 15.1 | 30.2 | 733 | 22.8 | 86 | 40 |
| | T: 3 | 14.5 | 29.0 | 750 | 24.2 | 93 | 80+ |
| 2230 | C: 1 (2 failed) | 15.5 | 31.0 | 660 | 18.9 | 77 | 10 |
| | T: 3 | 13.7 | 27.5 | 664 | 21.1 | 82 | 70 |
| 2806 | C: 1 | 14.9 | 29.5 | 557 | 17.5 | 64 | 10 |
| | T: 3 | 14.0 | 28.1 | 611 | 20.3 | 82 | 47 |
| 5038 | C: 0 | (all 3 failed) | | | | | |
| | T: 3 | Continue to burn, no photometry taken. | | | | | |

In as much as lamp life is determined by cathode coating depletion, the three remaining test lamps at 5,038 hours appear to have more hours of operation remaining. All control lamps have failed.

The discharge voltage stabilizing effect of the krypton additive is clearly evident in this data. This accounts for the excellent cathode coating retention, and the stable lamp color observed in the test lamps. The control lamps showed pink neon glow discoloration starting as early as 136 hours. Also shown in TABLE II is the discovery that beyond about 500 hours, the initial lumens and lumens per watt penalty for the krypton has disappeared, due to improved lumen maintenance.

There has thus been shown and described an improved negative glow discharge lamp. It has been discovered that small quantities of krypton added to a neon fill of a negative glow discharge lamp containing mercury results in significant gains in lamp life, color stability, and lumen maintenance.

While there have been shown and described what are at present considered to be the preferred embodiments of the invention, it will be apparent to those skilled in the art that various changes and modifications can be made herein without departing from the scope of the invention. The matter set forth in the foregoing description and accompanying drawings is offered by way of illustration only and not as a limitation. The actual scope of the invention is intended to be defined in the following claims when viewed in their proper perspective based on the prior art.

What is claimed is:

1. A negative glow discharge lamp comprising:

a light-transmitting envelope containing an ionizable medium at a low pressure including mercury and a gaseous fill comprising substantially neon and krypton, said krypton being in an amount less than five percent of the total gaseous fill;

a pair of electrodes disposed in said envelope and exposed to said gaseous fill; and lead-in wires coupled to the electrodes and extending through and hermetically sealed in said envelope.

2. The negative glow discharge lamp of claim 1 wherein said amount of krypton is less than two percent of the total gaseous fill.

3. The negative glow discharge lamp of claim 2 wherein said amount of krypton is equal to one-half percent of the total gaseous fill.

4. The negative glow discharge lamp of claim 1 wherein said pressure is 1.5 torr.

5. A negative glow discharge lamp comprising:

a light-transmitting envelope containing an ionizable medium at a low pressure including mercury and a gaseous fill consisting essentially of neon and krypton, said krypton being in an amount less than five percent of the total gaseous fill;

a pair of electrodes disposed in said envelope and exposed to said gaseous fill; and lead-in wires coupled to the electrodes and extending through and hermetically sealed in said envelope.

6. The negative glow discharge lamp of claim 5 wherein said amount of krypton is less than two percent of the total gaseous fill.

7. The negative glow discharge lamp of claim 6 wherein said amount of krypton is equal to one-half percent of the total gaseous fill.

8. The negative glow discharge lamp of claim 5 wherein said pressure is 1.5 torr.

9. A negative glow discharge lamp comprising:

a light-transmitting envelope containing an ionizable medium at a low pressure including mercury and a gaseous fill comprising 99.5 percent neon and 0.5 percent krypton;

a pair of electrodes disposed in said envelope and exposed to said gaseous fill; and lead-in wires coupled to the electrodes and extending through and hermetically sealed in said envelope.

* * * * *